United States Patent [19]

Litzenberger

[11] Patent Number: 4,976,081

[45] Date of Patent: Dec. 11, 1990

[54] SANDWICH PANEL ASSEMBLY

[75] Inventor: Ernest N. Litzenberger, Boyertown, Pa.

[73] Assignee: Bally Engineered Structures, Inc., Bally, Pa.

[21] Appl. No.: 135,394

[22] Filed: Dec. 21, 1987

[51] Int. Cl.[5] ..... E04B 1/78

[52] U.S. Cl. ..... 52/309.11; 52/426

[58] Field of Search ..... 52/309.9, 309.11, 426, 52/427, 428, 809, 563; 220/437, 440, 444, 445, 901

[56] References Cited

U.S. PATENT DOCUMENTS

| | | | |
|---|---|---|---|
| 798,773 | 9/1905 | Fisher | 52/526 |
| 1,578,511 | 3/1926 | Gladwin | 52/426 |
| 2,158,082 | 5/1939 | Morrell | 72/1 |
| 2,862,585 | 12/1958 | McChesney | 189/88 |
| 3,155,265 | 11/1964 | Reese | 220/437 |
| 3,353,314 | 11/1967 | Melcher | 52/127 |
| 3,472,728 | 10/1969 | Hitch | 161/69 |
| 3,496,692 | 2/1970 | Melcher | 52/583 |
| 3,760,548 | 9/1973 | Sauer et al. | 52/309.11 X |
| 4,064,664 | 12/1977 | Gaul | 52/136 |
| 4,183,393 | 1/1980 | Bailey | 52/309.11 X |
| 4,402,167 | 9/1983 | Denucci | 52/426 |

FOREIGN PATENT DOCUMENTS

| | | | |
|---|---|---|---|
| 236191 | 10/1961 | Australia | 220/901 |
| 1293237 | 5/1961 | France | 220/901 |
| 351158 | 5/1931 | United Kingdom | 220/901 |

*Primary Examiner*—David A. Scherbel
*Assistant Examiner*—Jerrold D. Johnson
*Attorney, Agent, or Firm*—Parmelee, Miller, Welsh & Kratz

[57] ABSTRACT

A sandwich panel assembly for refrigerated and non-refrigerated structures has an insulating layer disposed between two facings. A chain having hooks or a wire is attached to the facings and is entirely embedded in the insulating layer for positively connecting the faces together. Cable or strapping may be used in place of the connecting or wire. A thermal insulation prevents thermal short circuits from a facing through the chain or wire.

11 Claims, 1 Drawing Sheet

SANDWICH PANEL ASSEMBLY

This invention relates to improvements in sandwich panel assemblies which may be fit together to form the walls, floors and ceilings of refrigerated buildings, walk-in coolers and freezers and also of non-refrigerated structures used for storing records and equipment in controlled atmospheres.

Sandwich panel assemblies generally comprise a relatively thick insulating material having low mechanical strength disposed between two facings. The insulating material is typically polyurethane or other suitable thermal insulating material. The facings are typically thin metal skins made of galvanized steel, stainless steel or aluminum. Other facings such as wood, gypsum or composites are used in place of metal. Conventional assemblies, their fabrication and their uses are disclosed in U.S. Pat. No. 3,353,314 to Melcher, U.S. Pat. No. 3,472,728 to Hitch and U.S. Pat. No. 4,402,167 to Denucci, which disclosures are incorporated by reference. The Denucci Patent, in particular, discloses a locking mechanism supported by transverse members extending between channels formed by the vertical edges of the facings where the transverse members have projections which are wedged into the channels. As these patents disclose, these assemblies are fabricated by positioning large heavy facings and panel assembly locking mechanisms relative to each other in a mold and then foaming the polyurethane in place between the facings. Alternatively to the foamed-in-place type of insulations, rigid preformed boards of insulation may be sandwiched between the facings. After fabrication, the panel assemblies are then transported to a site where they are fit together to form buildings or other structures.

In use, facings may be exposed to conditions such as fire or high wind which might cause the bond between the exposed facing and the interior layer to fail and the facing to separate from the assembly. For example, a wall of a building or cabinet might be exposed to a fire which could cause the bond between the polyurethane and an exposed facing to fail and the facing to fall away from the rest of the assembly. The exposed polyurethane could increase the intensity of the fire and add to its spread.

Although the Denucci Patent does not disclose structure for preventing the separation of a facing from the rest of the assembly, assemblies having similar transverse members with projections wedged into channels formed at the edges of the facings have been fabricated for spacing the facings in the foaming mold. However, these transverse members are generally not used because they frequently cannot be held in place in the channels when the sides and ends of the facings are repositioned and manipulated in the mold. Particularly, transverse members wedged upside down in the top channel of the mold may fall out of the channel. In use, the transverse members tend to function as thermal short circuits because of the thermal conductivity of the transverse members and their substantial area of contact with one or both of the facings. Thermally insulating inserts could be positioned between the facing and transverse members, but this results in a practical problem of having to wedge many pieces together at several locations in the assembly. In the event of a bond failure caused, e.g., by high temperature of a fire at a facing, the exposed facing may vertically slide from the rest of the assembly because there are no positive connections between the facings and the transverse members.

The sandwich panel assembly of the present invention prevents an exposed panel from separating from the rest of the assembly when there is a bonding failure. This assembly has a tethering means disposed within the layer of insulation and linked with the facings for positively connecting the facings together. Minimal contact areas between the facings and tethering means and a means for thermally insulating the tethering means restrict thermal short circuits from a facing exposed to a fire. The tethering means is preferably a chain, wire or rope which is linked to the facings by clasps such as hooks or fasteners such as rivets or bolting which extend through holes in the facings. The thermal insulating means is preferably a coating on at least some of the links of a chain or an insert disposed between a wire or rope and at least one facing. Such a structure is more easily manipulated in a mold because a tethering means permits each facing to be handled independently of the other and a positive connection between the facings and the tethering means permits the facings to be repeatedly inclined or repositioned relative to each other without having the tethering means fall out of place.

Other details, objects and advantages of the present invention will become apparent as the following description of certain preferred embodiments thereof proceeds.

The accompanying drawings show certain preferred embodiments of the invention in which.

Figure 1:
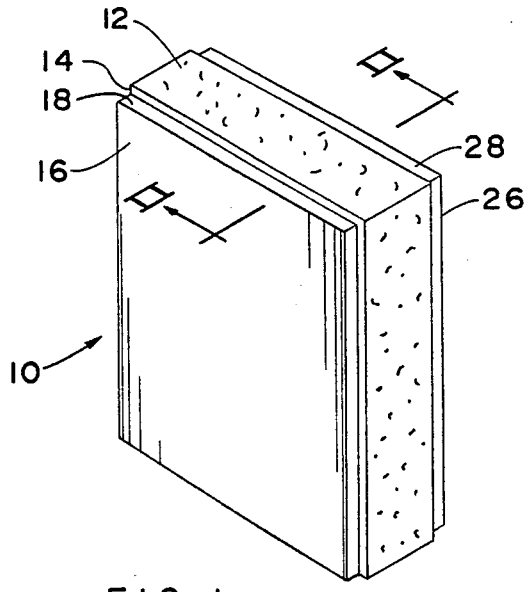
FIG. 1 is a perspective schematic view of a sandwich panel assembly with which the present invention is used.

FIG. 1 generally shows a sandwich panel assembly 10 which may be used in, e.g., the wall of a refrigerated building. The wall is typically formed by a plurality of such assemblies, which are commercially available as modules of standardized sizes of up to about twelve feet or more in length by about four feet in width. The assembly 10 comprises an interior insulating material 12 which is preferably foamed-in-place polyurethane and the following description will generally describe such materials. The insulating material may alternatively be preformed polyurethane boards or other suitable insulating materials. The thickness of the interior material 12 is about four to six inches for the most common refrigeration applications when polyurethane is used. The interior material 12 is disposed between two facings 16 and 26. As is shown, the facings may be a thin metal skin of up to about 20 to 26 gauge thickness for steel facings and up to about 0.05 inch thickness for aluminum.

As is shown in FIG. 1, each assembly 10 may have a tongue 14 extending beyond the top and one side of the facings 16, 26. Each assembly 10 may also have a grooved side (not shown) for receiving the tongue of an adjacent panel assembly or other structural member to form a wall or ceiling or floor. The assemblies 10 are then latched together by locking devices (not shown) such as those shown by the Melcher and Denucci Patents to form a rigid structure having tight tongue and groove joints between the assemblies. Alternatively, the panel assemblies may be mechanically attached to a frame and latched together.

Figure 2:
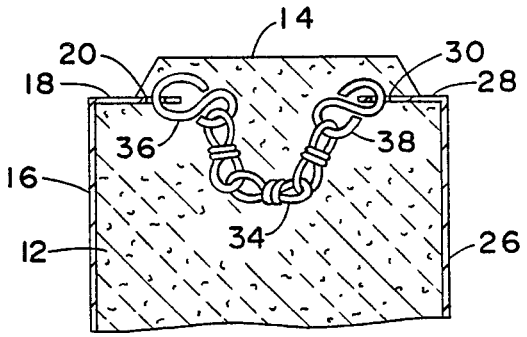
FIG. 2 is a partial sectional schematic view of the sandwich panel assembly of FIG. 1 which shows a first preferred embodiment of the present invention.
Figure 3:
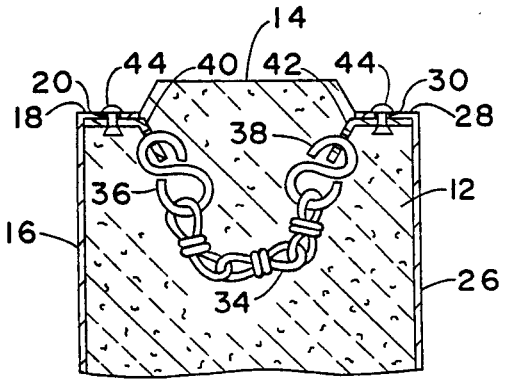
FIG. 3 is a partial schematic sectional view of the sandwich panel assembly of FIG. 1 which shows a second preferred embodiment of the present invention.
Figure 4:
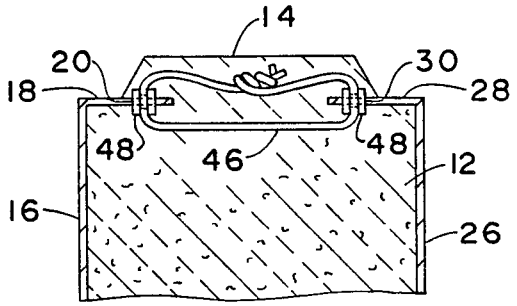
FIG. 4 is a partial sectional view of the sandwich panel assembly of FIG. 1 which shows a third preferred embodiment of the present invention.

FIGS. 2, 3 and 4 show preferred embodiments of the tethering means for positively connecting the faces 16, 26 at, e.g., section line II—II shown in FIG. 1. Preferred embodiments of the insulating means are also shown. Although only one tethering means is shown, a commercial module may have several means located along one or more vertical and/or horizontal edges of the facings 16, 26 so that no portion of a facing 16 or 26 can separate from the rest of the assembly 10 in case of bond failure. As these Figures show in cross section, the facings may have inwardly directed flanges 18, 28 with holes 20, 30 for receiving the tethering means.

Figure 5:
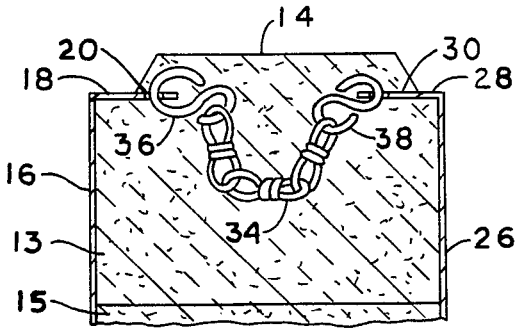
FIG. 5 is a partial sectional schematic view of a sandwich panel assembly showing a forth preferred embodiment of the present invention.

FIG. 2 shows a tethering means comprising a chain length 34 with hooks 36, 38 at its ends. Hook 36 is linked in hole 20 of facing 16 and hook 38 is linked in hole 30 of facing 26 to positively connect the facings together. The hooks 36, 38 may be inserted in the holes 20, 30 and crimped shut in the foaming mold. The length of chain 34 allows sufficient relative movement of the large heavy facings 16, 26 when they are in the mold and limits their movement from the rest of the assembly in use. The small areas of contact between the linkages of the chain 34 and between the hooks 36, 38 and the flanges 18, 28 limit the transfer of heat from an exposed facing through the chain. Preferably some, and most preferably all, of the linkages are coated with a thermal insulation to further limit thermal short circuiting at the small areas of contact between the linkages. Also, hooks 36, 38 may be coated as well.

Where preformed boards of insulation, such as boards 13 and 15 shown in FIG. 5, are sandwiched between the facings 16, 26, the flanges 18, 28 may be linked together with the tethering means before or after the assembly is laminated. In both cases a patching type insulation or caulking would be applied over the tethering means and fill the void in the insulation layer.

FIG. 3 shows an embodiment of the invention for positively connecting hooks 36 and 38 of FIG. 2 to the facings 16, 26 where the holes 20, 30 in the flanges 18, 28 are not covered by a tongue 14. This embodiment enables the entire tethering means to be embedded in the foam. Prior to fabrication of the assembly 10, the hooks 36, 38 of the tethering means of FIG. 2 are positively connected to inserts 40, 42 respectively. The inserts 40, 42 may then be attached to the flanges 18, 28 of facings 16, 26 respectively by rivets 44 or other suitable fasteners. The inserts 40, 42 may be made of any suitably strong material. The inserts may also be coated with a thermal insulation to prevent a thermal short circuit to the connecting chain 34 or a thermally insulating washer or tape may be placed between the flanges 18, 28 and the inserts 40, 42 for preventing a short circuit. Alternatively, where the inserts are not coated, the inserts 40, 42 may be welded to the flanges 18, 28 of the facings 16, 26 respectively.

FIG. 4 shows an embodiment of the invention where a wire 46 is attached to the facings 16, 26 through holes 20, 30. Tubular inserts 48 of any suitably thermally insulating material may be inserted in the holes 20, 30 to insulate the connecting wire 46 from the flanges 18, 28 respectively, where the wire is not itself coated. Also the wire 46 may be used with inserts 40, 42 of FIG. 3 where the holes 20, 30 in flanges 18, 28 are not embedded by the tongue 14. In addition to a chain 34 or wire 46, other tethering means, such as cables, strapping, or wire rope, may alternatively be used.

A standardized full scale building corner fire test was conducted on a corner formed by the intersection of two perpendicular walls comprising sandwich panel assemblies embodying the present invention. The assemblies had six-inch thick polyurethane foam cores disposed between 0.026-inch thick galvanized steel faces. Some assemblies were necessarily supported to structural steel supports by throughbolt fasteners in accordance with the standardized testing requirements. A fire ignited in the corner one foot from each wall was designed to produce 1000° F. at the wall within 5 minutes and the fire burned for at least 15 minutes. The facing exposed to the fire did not slip from the assembly and the assembly did not produce a self propagating flame. In similar tests on panels without a tethering means linked to the facings, the exposed facings of some wall panel assemblies peeled open and exposed the combustible core material to the fire.

While certain presently preferred embodiments of the present invention have been shown and described, it is to be distinctly understood that the invention is not limited thereto but may be otherwise variously embodied within the scope of the following claims.

What is claimed is:

1. A sandwich panel assembly comprising a generally continuous layer of insulation disposed between two facings and a tethering means having at least one chain link, the tethering means disposed within the insulation layer and linked with both facings for positively connecting the facings together.

2. The assembly of claim 1 wherein the facings have inwardly directed flanges and the tethering means comprises a chain length having hooks at its ends, further comprising inserts attached to the flanges and having holes for receiving the hooks for linking the flanges of the facings with the tethering means.

3. The assembly of claim 2, wherein the inserts are attached to the facings with rivets.

4. The assembly of claim 1 wherein the facings have inwardly directed flanges with holes and the tethering means comprises a wire extending through the holes in the flanges.

5. The assembly of claim 1 wherein the layer of insulation is foamed-in-place between the facings.

6. The assembly of claim 1 wherein the layer of insulation between the facings is preformed before the assembly is laminated together.

7. A sandwich panel assembly comprising a layer of thermal insulation disposed between two facings and a tethering means disposed within the insulation layer and linked with both facings for positively connecting the facings together, wherein the facings have inwardly directed flanges with holes and the tethering means comprises a chain length having hooks at its ends, with one hook extending through the hole of one facing and with the second hook extending through the hole of the second facings.

8. A sandwich panel assembly comprising: a layer of thermal insulation disposed between two facings; a tethering means disposed within the insulation layer and linked with both facings for positively connecting the facings together; and thermal insulation means for restricting the transfer of heat through the tethering means.

9. The assembly of claim 8 wherein the tethering means comprises a wire and the insulation means comprises an insert between the facings and the wire.

10. The assembly of claim 8 wherein the tethering means comprises a wire and the insulation means comprises a coating on the wire.

11. A sandwich panel assembly comprising a layer of thermal insulation disposed between two facings and a chain disposed within the insulation layer and linked with both facings for positively connecting the facings together, the chain having a coating for restricting the transfer of heat through the chain.

* * * * *